United States Patent [19]

Meinhardt

[11] 4,123,370

[45] Oct. 31, 1978

[54] PREPARATION AND USE OF BASIC METAL SALT COMPOSITIONS OF PHOSPHORUS-CONTAINING ACIDS

[75] Inventor: Norman A. Meinhardt, Lyndhurst, Ohio

[73] Assignee: The Lubrizol Corporation, Wickliffe, Ohio

[21] Appl. No.: 890,563

[22] Filed: Mar. 20, 1978

Related U.S. Application Data

[62] Division of Ser. No. 798,738, May 19, 1977, Pat. No. 4,089,793.

[51] Int. Cl.[2] ..... C10M 1/48; C10M 3/42; C10M 1/44; C10M 3/38

[52] U.S. Cl. ..... 252/32.7 E; 252/32.5; 252/400 A

[58] Field of Search ..... 252/32.5, 32.7 E, 400 A

[56] References Cited

U.S. PATENT DOCUMENTS

| | | | |
|---|---|---|---|
| 2,794,780 | 6/1957 | Wystrach et al. | 252/32.7 E |
| 2,945,810 | 7/1960 | Walker | 252/32.7 E |
| 3,008,900 | 11/1961 | May et al. | 252/32.7 E |
| 3,347,790 | 10/1967 | Meinhardt | 252/32.5 |
| 3,400,106 | 9/1968 | Morita | 260/79.5 |
| 3,514,476 | 5/1970 | Morita | 260/429.9 |
| 3,843,530 | 10/1974 | Niedzieleki | 252/32.7 E |
| 3,969,293 | 7/1976 | White et al. | 260/22 CB |

FOREIGN PATENT DOCUMENTS

| | | | |
|---|---|---|---|
| 1,358,478 | 7/1974 | United Kingdom | 252/32.7 E |

OTHER PUBLICATIONS

Wystrach et al., J. Organic Chemistry, vol. 21, p. 705, (1956).

Bacon et al., Journal Organic Chemistry, vol. 27, p. 1484, (1962).

Abstract of West German Publication, 1,794,423.

*Primary Examiner*—Irving Vaughn

*Attorney, Agent, or Firm*—James W. Adams, Jr.; Daniel N. Hall; Raymond F. Keller

[57] ABSTRACT

Reaction mixtures comprising components (A) Group II metal salts of phosphorus-containing acids, (B) basically reacting alkali metal compounds, and (C) optionally, di- or trivalent metal-containing salts are suitable for the preparation of basic metal salt compositions of phosphorus-containing acids, with the proviso that components (A), (B), and (C) are not the same. The basic metal salt compositions are useful in the preparation of lubricants.

44 Claims, No Drawings

PREPARATION AND USE OF BASIC METAL SALT COMPOSITIONS OF PHOSPHORUS-CONTAINING ACIDS

CROSS REFERENCE TO RELATED APPLICATIONS

This application is a division of copending application U.S. Ser. No. 798,738, filed May 19, 1977, U.S. Pat. No. 4,089,793.

This invention concerns basic metal salt compositions of phosphorus-containing acids. More specifically, this invention concerns reaction mixtures and processes suitable for preparation of these basic metal salt compositions, these compositions being useful as additives in lubricants. This invention also concerns concentrates of these additives and to lubricant compositions comprising these additives.

The desirability of certain basic metal salt compositions of phosphorus-containing acids is known and procedures for their preparation have been proposed heretofore. Of interest in this regard are U.S. Pat. Nos. 2,794,780; 3,843,530; Wystrach et al., J. Org. Chem., 21, 705 (1956); and Bacon et al., J. Org. Chem., 27, 1484 (1962). These disclosures are incorporated herein by reference.

It has now been discovered that basic metal salt compositions of phosphorus-containing acids can be prepared from reaction mixtures and processes as set forth herein. Compositions of this invention exhibit desirable thermal stability thereby providing long lasting additive protection. Moreover, other properties of these compositions such as extreme pressure, antiwear or oxidation inhibition make them advantageous in lubricating and other compositions.

Accordingly, it is a principal object of this invention to provide novel reaction mixtures suitable for the preparation of basic metal salt compositions of phosphorus-containing acids.

It is another object of this invention to provide processes suitable for the preparation of these basic metal salt compositions.

It is a still further object of this invention to provide basic metal salt compositions useful as additives for lubricants.

It is an even further object of this invention to provide concentrates comprising these basic metal salt compositions.

An additional object is to provide lubricant compositions comprising these basic metal salt compositions.

These and other objects will be apparent to one of ordinary skill in the art from the hereinafter detailed description of this invention.

The reaction mixture, suitable for the preparation of basic metal salt compositions of one or more phosphorus-containing acids, comprises: A) at least one Group II metal salt of one or more phosphorus-containing acids of the formula:

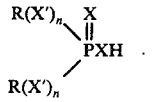

(I)

wherein each X and X′ are independently oxygen or divalent sulfur with the proviso that each $n$ may be zero or one, each R is independently the same or a different hydrocarbon-based radical and the Group II metal has an atomic weight between about 24 and 115; (B) at least one basically reacting alkali metal compound; (C) optionally, at least one di or trivalent metal-containing salt or mixture thereof; and (D) preferably, a solvent/diluent medium, wherein the equivalent ratio of the acid of (A):(B):(C) in the reaction mixture is sufficient to form a basic or a more basic salt of (A) and wherein zinc or cadmium is present in the reaction mixture in either (A) or (C) or both.

The phosphorus-containing acids used in making this invention each have one acid equivalent, that is, one replaceable hydrogen. The terminology "basic metal salt" or "basic metal salts" as used herein ("herein" when used includes the claims) describes salts of phosphorus-containing acids which have excess metal cation. "Basic metal salt" or "basic metal salts" accordingly refers to salts wherein the phosphorus-containing acids have excess metal equivalents over that which is necessary to replace the one acid equivalent of the phosphorus-containing acid. The basic metal salt compositions of this invention contain these basic metal salts which have excess metal cation.

Similarly, a "more basic salt" refers to salts which have increased basicity over the starting salt. For example, this invention contemplates starting with salts having excess metal equivalents and increasing that level in accordance with this invention.

The phosphorus-containing acids from which the salts of (A) can be made are known. Illustrative examples of some preferred phosphorus- and sulfur-containing acids are:

1. Dihydrocarbylphosphinodithioic acids, such as amylphosphinodithioic acid, corresponding to the formula $(C_5H_{11})_2P(S)SH$;

2. S-hydrocarbyl hydrogen hydrocarbylphosphonotrithioates, such as S-amyl hydrogen amylphosphonotrithioate, corresponding to the formula, $(C_5H_{11})(C_5H_{11}S)P(S)SH$;

3. O-hydrocarbyl hydrogen hydrocarbylphosphonodithioates, such as O-amyl hydrogen amylphosphonodithioate, corresponding to the formula, $(C_5H_{11})(C_5H_{11}O)P(S)SH$;

4. Dihydrocarbyl hydrogen phosphorotetrathioates, such as diamyl hydrogen phosphorotetrathioate, corresponding to the formula, $(C_5H_{11}S)_2P(S)SH$;

5. O,S-dihydrocarbyl hydrogen phosphorotrithioates, such as O,S-diamyl hydrogen phosphorotrithioate, corresponding to the formula, $(C_5H_{11}O)(C_5H_{11}S)P(S)SH$; and 6. O,O-dihydrocarbyl hydrogen phosphorodithioates, such as O,O-diamyl hydrogen phosphorodithioate, corresponding to the formula, $(C_5H_{11}O)_2P(S)SH$.

Preferred acids of the formula $[(RO)_2PSSH]$ are readily obtainable from the reaction of phosphorus pentasulfide ($P_4S_{10}$) and an alcohol or phenol. The reaction involves mixing at a temperature of about 20° to about 200° C., 8 moles of the alcohol of phenol with one mole of phosphorus pentasulfide. Hydrogen sulfide is liberated in this reaction.

The oxygen containing analogs are conveniently prepared by treating with water or steam which, in effect, replaces one or both of the sulfur atoms.

Thus, as previously mentioned, the preferred phosphorus-containing acids are phosphorus and sulfur-containing acids. These preferred acids more preferably include those wherein at least one X is divalent sulfur, more preferably both of X are divalent sulfur; at least one X' is oxygen or sulfur, more preferably both of X' are oxygen and $n$ is 1. Mixtures of acids may be employed according to this invention.

The terminology of "hydrocarbon-based radical" as used herein, ("herein" when used includes the appended claims) is used to define a substantially saturated monovalent radical derived from a hydrocarbon by removal of a hydrogen from a carbon atom of the hydrocarbon. This carbon atom is directly connected to the remainder of the molecule. These hydrocarbon-based radicals are derived from aliphatic hydrocarbons, cyclo-aliphatic hydrocarbons, aromatic hydrocarbons, mixed aliphatic-cyclo-aliphatic hydrocarbons, mixed aliphatic aromatic hydrocarbons, and mixed cyclo-aliphatic-aromatic hydrocarbons. The base hydrocarbons from which these radicals are derived may contain certain non-reactive or substantially non-reactive polar or non-hydrocarbon substituents.

The terminology "substantially saturated" as used herein is intended to define radicals free from acetylenic unsaturation (—C≡C—) in which there is not more than 1 ethylenic linkage (—C=C—) for every 10 carbon-to-carbon (preferably 20) covalent bonds. The so-called "double bonds" in the aromatic ring (e.g., benzene) are not to be considered as contributing to unsaturation with respect to the terminology "substantially saturated". Usually there will be no more than an average of one ethylenic linkage per substantially saturated monovalent radical as described hereinbefore. Preferably, (with the exception of aromatic rings) all the carbon-to-carbon bonds in a substantially saturated radical will be saturated linkages; that is, the radical will be free from acetylenic and ethylenic linkages.

In general, the hydrocarbon-based radical may contain up to about 30 carbon atoms with a preferred range of carbon atoms being from 1 to about 20. The hydrocarbon-based radicals may contain certain non-reactive or substantially non-reactive polar or non-hydrocarbon substituents which do not materially interfere with the reactions or compositions herein, as will be recognized by those in the art. Representative non-hydrocarbon or polar substituents include halo substituents, such as chloro, fluoro, bromo and iodo; nitro; lower alkoxy, such as butoxy and hexyloxy; lower alkyl thio, such as pentylthio and heptylthio; hydroxy; mercapto;

$$-\overset{\overset{\displaystyle O}{\|}}{C}O-$$

hydrocarbyl, e.g., $$-\overset{\overset{\displaystyle O}{\|}}{C}-$$

lower alkyl; hydrocarbyl $$O-\overset{\overset{\displaystyle O}{\|}}{C}-$$

hydrocarbon and the like. As a general rule, and particularly when the basic metal salt compositions of this invention are to be used as lubricant additives, the degree of substitution and nature of the substituent of the hydrocarbon-based radical is such that the predominantly hydrocarbon character of the radical is not destroyed. Thus, in view of this requirement, these radicals normally have no more than 4 substituents per radical, and usually, not more than one substituent for every 10 carbon atoms in the radical.

Desirable basic metal salt compositions of this invention include those made from phosphorus-containing acids wherein each R is hydrocarbyl, particularly independently alkyl, aryl, alkaryl and arylalkyl of up to about 30 carbon atoms, more preferably from 3 to about 20 carbon atoms. For example, one R can contain at least 5 carbon atoms and together both R's contain a total of at least eight carbon atoms. Usually, in this latter circumstance, the R groups are alkyl.

The Group II metal salts of (A) can be prepared in accordance with any convenient method known in the art. Generally, the salts of (A) will contain about one equivalent of acid per each equivalent of metal (i.e., normal salt), but they may be mixtures which contain from about 0.3 to about 1.3 equivalent of the metal per equivalent of the phosphorus-containing acid. Thus, the Group II salts of (A) may be acid salts (i.e., containing less than about one equivalent of metal cation for each equivalent of acid), normal salts (i.e., about one equivalent of metal cation for each equivalent of acid), or basic salts (i.e., greater than about one equivalent of metal cation for each equivalent of acid). Usually, the Group II salts of (A) will be substantially normal salts, that is, having about 0.95 to about 1.05 equivalents of Group II metal for each equivalent of phosphorus-containing acid. The preferred Group II metal salts are zinc and cadmium with zinc being the more preferred, especially if the compositions are formed without further reaction with the salts of (C).

These Group II metal salts are conventionally prepared, for example, by reacting one or more phosphorus-containing acids with a basically reacting Group II metal compound (e.g., metal oxide) or metal under conditions shown in the prior art. Examples of preparations are in U.S. Pat. Nos. 2,797,238; 2,809,479; 2,838,556; 2,861,907; 2,905,683; 3,029,268; 3,190,833; 3,211,649; 3,277,133; 3,335,158; 3,401,185; 3,413,327; 3,654,329; and 3,803,037. These patents are expressly incorporated herein by reference for such preparations. They also may be prepared in situ in the reaction mixtures of this invention by, for example, adding together the phosphorus-containing acid and Group II metal or oxide thereof.

Component (B) of the reaction mixtures of this invention comprises at least one basically reacting alkali metal compound. These basically reacting alkali metal compounds may be inorganic, organic or mixtures of inorganic and organic compounds. They may be added to the reaction mixtures of this invention in the form of organic or inorganic compounds or, alternatively, also formed in situ (e.g., sodium metal in liquid amine or ammonia) in the reaction mixtures. The basically reacting alkali metal compounds employed normally exhibit greater basicity than the Group II salts of the phosphorus-containing acids of (A).

Preferably, the basically reacting alkali metal compounds of (B) will be added to the reaction mixtures of this invention as hydroxides, alkoxides (derived from alcohols of up to 10 carbon atoms, particularly lower alkanols of up to 7 carbon atoms), carboxylates, oxides, hydrides, carbonates, amides and the like. Exemplary basically reacting alkali metal compounds include sodium hydroxide, potassium hydroxide, lithium hydroxide, sodium methoxide, sodium butoxide, sodium amide, potassium amide, lithium amide, sodium dioxide, lithium oxide, and potassium oxide. Conveniently useful basically reacting alkali metal compounds include those of inorganic nature such as hydroxides and oxides, e.g., alkali metal hydroxides or oxides such as sodium hydroxide, lithium hydroxide, and potassium hydroxide as well as mixtures containing these.

Component (C), optionally included in or reacted with the reaction mixtures of this invention, is at least one di- or trivalent metal-containing salt or a mixture of these salts. The di- and trivalent metal cations of these salts include metal cations of Group II metals such as magnesium, calcium, zinc, cadmium and barium; Group III metals such as aluminum and scantium; Group IV metals such as zirconium and tin; and Group V metals such as antimony and bismuth as well as chromium and manganese. Preferred di- and trivalent metal cations include zinc, calcium, tin, nickel, magnesium, barium, antimony and cadmium, particularly zinc, magnesium, calcium, cadmium and antimony. If the salts of (A) are other than zinc or cadmium salts, then (C) is added and comprises zinc and/or cadmium salts, particularly zinc salts.

The di- and trivalent metal cations are added to the reaction mixture in their salt or salt complex forms. The anions of these salts may be organic or inorganic and are quite diverse. Exemplary anions include halo anions such as chloride, bromide, perchlorate, and the like; carboxylate anions such as formate, acetate, adipate, valerate, palmate, stearate and the like; carbonate anions; sulfur-containing anions such as sulfonate (e.g., methane sulfonate) and petroleum sulfonate; nitrogen-containing anions such as nitrate and nitrite; phosphorus-containing anions such as phosphates and phosphonates; aromatic-containing anions such as benzoates (e.g., chlorobenzoate) and the like. Usually preferred anions are highly polar anions (e.g., inorganic) such as halide (or pseudo-halide (e.g., cyanide or thiocyanide)) such as chloride and bromide, or sulfate, or nitrate, and the like as well as anions of low molecular weight carboxylates such as acetate, adipate, and citrate. The salts of (C) may comprise those with one or more anions as hereinbefore described. Salts having anions nominally of proton strong acids are, however, preferred, if removal of the anion is desired. Strong acids are used herein to describe those materials which have a dissociation constant of at least about $1 \times 10^{-4}$ at 25° C. in aqueous solution. In general the preferred strong acids are mineral acids such as HCl, HBR, $H_2SO_4$, $H_3PO_4$, $HNO_3$, etc.

The salts of (C) are normally chosen so that they can be solubilized or dispersed in the reacton mixtures of this invention. Upon addition to the compositions comprising components (A) and (B), it is desirable that the anions of (C) become allied with the alkali metal cation of the basically reacting alkali metal compound (B). This association may be facilitated by appropriate choice of solvent/diluent medium (D). Thereafter, salt formed from the basically reacting alkali metal compound and the anion of the di- or trivalent metal cation may be removed, if desired, by conventional means, e.g., filtration, to form preferred compositions of this invention. This removal is particularly facilitated by choice of a solvent/diluent medium. This removal or complete removal, however, is not required.

Reaction mixtures comprising components (A) and (B), (optionally, solvent/diluent medium (D)) are preferably reacted at temperatures from about 20° C. up to the decomposition temperature of the reactants or products. A more preferred range includes from about 30° C. to about 150° C. (e.g., 40°-100° C.). Of course, the minimum temperature employed is sufficient to provide a liquid reaction mixture. The period of time for reaction varies with several factors including nature and amount of reactants, reaction equipment, solvent/diluent medium, degree of mixing, degree of desired reaction and the like. Reaction mixtures comprising components (A) and (B) usually are satisfactorily reacted in a period from about one quarter to about 4 hours although longer periods, e.g., 15 or more hours, may be necessary, particularly at lower temperatures of reaction, e.g., 30° C.

Reaction mixtures comprising components (A) and (B) (and optionally (C)) preferably also further comprise a substantially inert liquid solvent/diluent medium (D) (usually comprising from about 10% to about 80%, more preferably from about 30% to about 70% by weight of the reaction mixture), although such solvent/diluent medium is not required. This solvent/diluent medium desirably serves to maintain contact of the reactants and facilitate control of the reaction temperatures. Examples of suitable solvent/diluent media include aliphatic and aromatic hydrocarbons as benzene, toluene, naphtha, mineral oil, hexane; chlorinated hydrocarbons as dichlorobenzene, and heptylchloride; ethers as methyl n-amylether, n-butylether; alcohols as methanol, ethanol, isopropanol, butanol, and cyclohexanol. Desirably, the solvent/diluent medium includes a polar solvent or diluent. The polarity of either a sole or additional solvent or diluent facilitates separation of reaction product components, if desired. For example, if highly polar anions of (C) are employed, then a polar solvent/diluent can serve to aid in the removal of these anions, associated with the alkali metal cations of (B), especially where the solubility of the associated salt is low in the polar solvent/diluent medium. Aliphatic alcohols (e.g., lower alkanols, in particular), ethers and chlorinated hydrocarbons are advantageous in this regard.

As used in the specification and the appended claims, the term "substantially inert" when used to refer to solvents/diluents, and the like, is intended to mean that the solvent/diluent, etc., is sufficiently inert to chemical or physical change under the conditions in which it is used so as not to materially interfere in an adverse manner with the preparation, storage, blending and/or functioning of the compositions, additive, compound, etc., of this invention in the context of its intended use. For example, small amounts of a solvent/diluent, etc. can undergo minimal reaction or degradation without preventing the making and using of the invention as described herein. In other words, such reaction or degradation, while technically discernible, would not be sufficient to deter the practical worker of ordinary skill in the art from making and using the invention for its intended purposes. "Substantially inert" as used herein is, thus, readily understood and appreciated by those of ordinary skill in the art.

As used in the specification and the appended claims, the term "solvent/diluent medium" of component (D) is intended to include those solvent/diluent mediums in which independently each of the reactants (A), (B) and (C) are soluble or stably dispersible. The term "stably dispersible" as used in the specification and the appended claims is intended to mean a composition (e.g., a single compound, a mixture of two or more compounds, etc.) is capable of being dispersed in a given medium to an extent which allows it to function in its intended manner. Thus, for example, where a composition is prepared by a reaction in an oil, it is sufficient that the reactants be capable of being suspended in the oil in a manner sufficient to allow the reaction to occur and the formation of the composition. Thus, the "solvent/diluent medium" is understood and can be used in a conventional manner by those of ordinary skill in the art.

The product of reacting components (A) and (B) may be used as a lubricant additive. However, the compositions made by reacting (A) and (B) sometimes may be accompanied by the formation of by-products and/or excess solvent/diluent medium which may lessen its commercial appeal. Accordingly, these undesirable by-products and/or excess or undesired solvent/diluent medium can be separated from the basic metal salt compositions of this invention by techniques known in the art, e.g., filtration, evaporation, etc. to obtain a more desirable product. Alternatively, if the solvent/diluent medium is, for example, a base suitable for use in the lubricating compositions of this invention, the product can be left in the solvent/diluent medium and used to form the lubricating compositions as described below.

In a preferred aspect of this invention, the reaction mixtures further comprise (C) at least one di- or trivalvent metal-containing salt. The metal salts of (C) are preferably added after some reaction (e.g., one quarter hour to 4 hours) of the reaction mixture comprising components (A) and (B) as described above. Alternatively, the metal salt of (C) may be added to a reaction mixture together comprising components (A), (B) and, preferably, solvent/diluent medium (D). Still alternatively, the reaction mixtures may be formed by addition of components (A) and (C) (and optionally (D)) with later addition of component (B). Mixtures of salts may be used for component (C), such mixtures including salts of one or more different di- or trivalent cations and/or one or more different anions. Usually, however, for simplicity one divalent or one trivalent cation type (e.g., $Zn^{++}$ or $Sb^{+++}$) is added in salt form to the reaction mixture to form the more preferred basic metal salt compositions of this invention. Of course, different types of salts of (C) can be added sequentially, if desired. Moreover, basic metal salt compositions are also desirably achieved wherein one metal of (A) is different from one metal of (C).

The reaction of reaction mixtures comprising components (A), (B), (C) and, optionally (D), is carried out at temperatures and for periods of time as previously described for the reactions of components (A) and (B). For example, if (A), (B) and (C) are added simultaneously (or if (C) is added shortly after admixture of (A) and (B)), a reaction period for these mixtures of from about one-quarter hour to about four hours is usually sufficient, although longer periods, e.g., ten hours or more may be necessary at lower temperatures.

The equivalent ratio of reactants (A), (B) and optionally (C) is that which is sufficient to provide a more basic salt of (A). For example, if (A) and (B) are alone reacted, it is usually desirable that there be at least about 0.05 equivalent of (B) (more preferably about 0.2) for each equivalent of the acid of (A), when (A) is a substantially normal salt. Higher levels of equivalents, of course, are desired if (A) is an acid salt. A level of at least about 0.05 equivalents of (C) is desirable with a more preferred level of at least about 0.1 for each equivalent of the acid of (A). Generally, there is no practical advantage to use an equivalent ratio of acid of (A) to (B) to (C) of higher than about 1:6:3, usually 1:1:1. Excesses may be left in the reaction mixture, however, if desired. All equivalents are based on one equivalent for one replaceable hydrogen in a phosphorus-containing acid and one equivalent for each extant valence state of the metal (e.g., antimony has three equivalents).

In an especially preferred embodiment of this invention the Group II salt of (A) is a cadmium or zinc salt, particularly a zinc salt. The basically reacting alkali metal compound (B) is an alkali metal hydroxide (e.g., sodium hydroxide) and the solvent/diluent medium (D) comprises a polar solvent or diluent such as lower alkanol, (e.g., methanol), ethers or a chlorinated hydrocarbon, particularly lower alkanols.

In this especially preferred embodiment, the compositions comprising the Group II salt of (A) the basically reacting alkali metal compound (B), and the solvent/diluent medium (D) forming the reaction mixtures (or basic metal salt compositions, if reacted) of this invention are further reacted with certain salts of di- and trivalent metal cations of (C). These salts are preferably selected from the group consisting of zinc, cadmium, antimony, magnesium, nickel, and calcium, more preferably zinc, antimony and magnesium, particularly zinc salts. Examples of salts useful in this regard include antimony chloride, zinc chloride, magnesium chloride, calcium chloride, nickel chloride, zinc nitrate, antimony bromide, zinc carbonate and the like.

If the salt of the Group II metal of (A) is other than zinc, it is normally desirable to employ a zinc salt for (C). Thus, for example, the Group II salt of (A) can be magnesium or calcium and the preferred salts of (C) are one or more zinc salts, e.g., zinc chloride, zinc acetate, or zinc nitrate.

After reduction in this preferred embodiment these preferred compositions are normally purified to increase commercial appeal. Thus, the compositions can be filtered, centrifuged and the like followed by reduction of solvent/diluent medium by evaporation (e.g., stripping) and the like, all of which are commonly employed in the art.

In all the reaction mixtures of this invention, other components may, of course, be present, if desired. For example, stabilizers such as dispersants of high molecular weight acids (e.g., reaction products of high molecular weight substituted succinic acids or anhydrides with amines, alcohols and the like) may be added for improved solubilization or compatibility. These and other expedients are understood in the art, e.g., see U.S. Pat. Nos. 3,489,652 and 3,595,790 both of which are herein incorporated by reference.

This invention is exemplified in the following examples. Of course, these examples are not intended as limiting this invention as modification of the examples by ordinary expedient will be readily apparent to those of ordinary skill in the art.

In all examples, unless otherwise stated, all temperatures are in degrees Centigrade; all parts are parts by weight; all percentages are derived from parts by weight; and all equivalents are based on a chemical equivalent of one for a phosphorus-containing acid with one replaceable hydrogen.

EXAMPLE 1

A reaction mixture is prepared by the addition of a solution of 232 parts (5.8 moles) of sodium hydroxide in 1420 parts of methanol to 5367 parts (8.7 moles) of a mineral oil-containing substantially normal zinc di(65% isobutyl/35% primary amyl)dithiophosphorate at 55° C. and then stirred for 1 hour at 55°-60° C. At 60° C. a solution of 294 parts (2.89 moles) of zinc chloride in 1420 parts of methanol is added to the mixture. The mixture is stirred for 1 hour at 60° C., then stirred to 65° C. under vacuum and filtered. The filtrate is the desired oil-containing product, which analyzes 12.4% zinc.

EXAMPLE 2

A reaction mixture is prepared by the addition of a solution of 136 parts (3.4 moles) of sodium hydroxide pellets in 870 parts of methanol to 4273 parts (5.1 moles) of a mineral oil-containing substantially normal zinc di(isooctyl)dithiophosphorate at 54° C. and then stirred for one-half hour. At 55° C. a solution of 231 parts (1.7 moles) of zinc chloride in 870 parts of methanol is added to the mixture. The mixture is stirred for one-half hour at 55° C., then stripped to 70° C. under vacuum and filtered. The filtrate is the desired oi-containing product, which analyzes 9.66% zinc.

EXAMPLE 3

The procedure for Example 2 is repeated except the sodium hydroxide is replaced by sodium methoxide on an equal molar basis. The desired product analyzes 9.46% zinc.

EXAMPLE 4

The reaction mixture of 2520 parts (3.0 moles) of a mineral oil-containing substantially normal zinc di(isooctyl)dithiophosphorate, a solution of 40 parts (1 mole) of sodium hydroxide pellets in 250 parts of methanol and a solution of 69 parts (0.5 mole) of zinc chloride in 250 parts of methanol is reacted according to the procedure set forth in Example 2. The desired product analyzes 8.62% zinc.

EXAMPLE 5

A reaction mixture is prepared by the addition of a solution of 216 parts (5.4 moles) of sodium hydroxide pellets in 1250 parts of methanol to 2476 parts (4.0 moles) of a mineral oil-containing substantially normal zinc di(65% isobutyl/35% primary amyl)dithiophosphorate and 3432 parts (4.0 moles) of a mineral oil-containing zinc di(isooctyl)dithiophosphorate at 53° C. and then stirred for one hour at 52° C. At 50° C. a solution of 368 parts (2.7 moles) of zinc chloride in 1420 parts of methanol is added to the mixture. The mixture is stirred for one-half hour at 50°-51° C., then stripped to 75° C. under vacuum and filtered. The filtrate is the desired oil-containing product, which analyzes 11.26% zinc.

EXAMPLE 6

The procedure for Example 1 is repeated except the mineral oil-containing zinc di(65% isobutyl/35% primary amyl)dithiophosphorate is replaced by a mineral oil-containing substantially normal zinc di(tetrapropenylphenyl)dithiophosphorate on an equal molar basis. The desired product analyzes 4.39% zinc.

EXAMPLE 7

A reaction mixture is prepared by the addition of a solution of 60 parts (1.5 moles) of sodium hydroxide pellets in 355 parts of methanol to 1287 parts (1.5 moles) of a mineral oil-containing substantially zinc di(isooctyl)dithiophosphorate at 50° C. and then stirred for one and one-half hours. At 55° C. a solution of 205 parts (1.5 moles) of zinc chloride in 395 parts of methanol is added to the mixture. The mixture is held for one hour at 65° to 70° C. and then 395 parts of methanol are removed by distillation. A solution of 60 parts of sodium hydroxide pellets in 355 parts of methanol is then added to the mixture. The mixture is held for one-half hour at 60° to 65° C. and stripped at 65° C. under vacuum and filtered. The filtrate is the desired oil-containing product, which analyzes 9.63% zinc.

EXAMPLE 8

A reaction mixture is prepared by the addition of a solution of 205 parts (1.5 moles) of zinc chloride in 315 parts of methanol to 1287 parts (1.5 moles) of a mineral oil-containing substantially normal zinc di(iso-octyl)dithiophosphorate at 50° C. and stirred for 2 hours. At 55° C. a solution of 120 parts (3 moles) of sodium hydroxide pellets in 555 parts of methanol is added to the mixture. The mixture is stirred for two hours at reflux, then stripped to 60° C. under vacuum and filtered. The filtrate is the desired oil-containing product, which analyzes 9.06% zinc.

EXAMPLE 9

A reaction mixture is prepared by the addition of a solution of 99 parts (1.5 moles) of potassium hydroxide pellets in 470 parts of isopropyl alcohol to 1287 parts (1.5 moles) of a mineral oil-containing substantially normal zinc di(iso-octyl)dithiophosphorate at 50° C. and then stirred for one-half hour. At 55° C. a solution of 205 parts of zinc chloride in 470 parts of isopropyl alcohol is added to the mixture. The mixture is stirred for one-half hour at 60° C. and a solution of 99 parts of potassium hydroxide pellets in 470 parts of isopropyl alcohol is added. The mixture is stirred for one-half hour at 65° C., then stripped at 55° C. under vacuum and filtered. The filtrate is the desired oil-containing product.

EXAMPLE 10

A reaction mixture is prepared by the addition of a solution of 40 parts (1.0 mole) of sodium hydroxide pellets in 395 parts of methanol to 1287 parts (1.5 moles) of a mineral oil-containing substantially normal zinc di(iso-octyl)dithiophosphorate at 60° C. and then stirred for one-half hour. At 60° C. a solution of 136 parts (1.0 mole) of zinc chloride in 395 parts of methanol is added to the mixture. The mixture is stirred for one-half hour, then a solution of 40 parts (1.0 mole) of sodium hydroxide pellets in 395 parts of methanol is added. The mixture is stirred for one-quarter of an hour at 60° C., then stripped to 65° C. under vacuum and filtered. The filtrate is the desired oil-containing product, which analyzes 10.12% zinc.

EXAMPLE 11

A reaction mixture is prepared by the addition of 341 parts (2.5 moles) of zinc chloride to 6270 parts (7.5 moles) of a mineral oil-containing substantially normal zinc di(iso-octyl)dithiophosphorate, 200 parts (5.0 moles) of sodium hydroxide pellets, 395 parts of isopropyl alcohol and 395 parts of methanol at 75° C. The mixture is stirred at 70° to 80° C. for 6 hours, then stripped to 70° C. under vacuum and filtered. The filtrate is the desired oil-containing product, which analyzes 9.68% zinc.

EXAMPLE 12

A reaction mixture is prepared by the addition of a solution of 60 parts (1.5 moles) of sodium hydroxide pellets in 355 parts of methanol to 2520 parts (3.0 moles) of a mineral oil-containing substantially normal zinc di(iso-octyl)dithiophosphorate at 52° C. and then stirred for one-half hour. At 54° C. a solution of 114 parts (0.5 mole) of antimony trichloride in 195 parts of methanol is added to the mixture. The mixture is stirred for one-half hour at 53° C., then stripped to 65° C. under vacuum and filtered. The filtrate is the desired oil-containing product, which analyzes 7.59% zinc and 2.28% antimony.

EXAMPLE 13

A reaction mixture is prepared by the addition of a solution of 62 parts (1.55 moles) of sodium hydroxide pellets in 395 parts of methanol to 2000 parts (4.65 moles) of a substantially normal magnesium di(30% decyl/70% isooctyl)dithiophosphorate at 51° C. and then stirred for three-quarters of an hour. At 52° C. a solution of 106 parts (0.78 mole) of zinc chloride in 395 parts of methanol is added to the mixture. The mixture is stirred for one and three-quarters hours at 52° C., then stripped to 65° C. under vacuum and filtered. The filtrate is the desired product, which analyzes 2.16% zinc and 2.12% magnesium.

EXAMPLE 14

A reaction mixture is prepared by the addition of a solution of 80 parts (2.0 moles) of sodium hydroxide pellets in 475 parts of methanol to 2527 parts (3.0 moles) of a mineral oil-containing substantially normal zinc di(iso-octyl)dithiophosphorate at 51° C. and then stirred for one-half hour. Stannus chloride dihydrate, 226 parts (1.0 mole), is then added to the mixture. The mixture is stirred for one-half hour at 56°–58° C., stripped to 65° C., under vacuum and filtered. The filtrate is the desired product.

EXAMPLE 15

The procedure for Example 2 is repeated except the zinc chloride is replaced by calcium chloride on an equal molar basis. The desired product analyzes 7.76% zinc and 1.25% calcium.

EXAMPLE 16

A reaction mixture is prepared by the addition of a solution of 27 parts (0.675 mole) of sodium hydroxide pellets in 475 parts of methanol to 863 parts (1.0 mole) of a mineral oil-containing substantially normal zinc di(isooctyl)dithiophosphorate at 50° C. The mixture was held at 50° to 55° C. for 2 hours, then stripped to 75° C. under vacuum and filtered. The filtrate is the desired product, which analyzes 7.19% zinc and 1.72% sodium.

EXAMPLE 17

A reaction mixture is prepared by the addition of a solution of 28 parts (0.667 mole) of lithium hydroxide hydrate in 870 parts of methanol to 863 parts (1.0 mole) of a mineral oil-containing substantially normal zinc di(isooctyl)dithiophosphorate at 45° C. The mixture is heated to 65° C. in one hour, then stripped to 118° C. under vacuum and filtered at 60° C. The filtrate is the desired oil-containing product, which analyzes 7.39% zinc and 0.483% lithium.

As previously indicated, the basic metal salt compositions of this invention are useful as additives for lubricants in which they can function primarily as oxidation inhibitors, antiwear agents and/or extreme pressure agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes (e.g., dodecylbenzenes, tetradecylbenzenes, dinonylbenzenes, di(2-ethylhexyl)-benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)siloxanes, poly-(methylphenyl)siloxanes, etc.). Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants of the present invention contain a lubricating improving amount of one or more of the basic metal salts of this invention, e.g., sufficient to provide it with improved oxidation stability, and/or antiwear and/or extreme pressure properties. These salts have additional properties such as corrosion inhibition. Normally the amount employed will be about 0.05% to about 20%, preferably about 0.1% to about 10% of the total weight of the lubricating composition. This amount is exclusive of solvent/diluent medium. In lubricating compositions operated under extremely adverse conditions, such as lubricating compositions for marine diesel engines, the basic metal salts of this invention may be present in amounts of up to about 30% by weight, or more, of the total weight of the lubricating composition.

The invention also contemplates the use of other additives in combination with the basic metal salt compositions of this invention. Such additives include, for example, detergents, dispersants of the ash-producing or ashless type, corrosion- and oxidation-inhibiting agents, pour point depressing agents, extreme pressure agents, antiwear agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

These ash-producing detergents may be basic salts used in combination with the basic metal salt compositions of this invention. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incroporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-$\beta$-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricating compositions of this invention. The following are illustrative:

(1) Reaction products of carboxylic acids (or derivatives thereof) containing at least about 34 and preferably at least about 54 carbon atoms with nitrogen-containing compounds such as amine, organic hydroxy compounds such as phenols and alcohols, and/or basic inorganic materials. Examples of these "carboxylic dispersants" are described in British Pat. No. 1,306,529 and in many U.S. patents including the following:

| | | |
|---|---|---|
| 3,163,603 | 3,351,552 | 3,541,012 |
| 3,184,474 | 3,381,022 | 3,542,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | Re 26,433 |
| 3,346,493 | 3,522,179 | |

(2) Reaction products of relatively high molecular weight aliphatic or alicyclic halides with amines, preferably polyalkylene polyamines. These may be characterized as "amine dispersants" and expamles thereof are described for example, in the following U.S. Pat. Nos.

| | |
|---|---|
| 3,275,554 | 3,454,555 |
| 3,438,757 | 3,565,804 |

(3) Reaction products of alkyl phenols in which the alkyl group contains at least about 30 carbon atoms with aldehydes (especially formaldehyde) and amines (especially) polyalkylene polyamines), which may be characterized as "Mannich dispersants". The materials described in the following U.S. patents are illustrative.

| | |
|---|---|
| 3,413,347 | 3,725,480 |
| 3,697,574 | 3,726,882 |
| 3,725,277 | |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein, for their disclosures of ashless dispersants.

Extreme pressure agents and corrosion- and oxidation-inhibiting agents useful in combination with the basic metal salts of this invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; and metal thiocarbamates, such as zinc dioctyldithiocarbamate, and barium heptylphenyl dithiocarbamate.

The basic metal salt compositions of this invention can be added directly to a lubricating aid by simple admixing to form the lubricating compositions of this invention or they can be (more conventionally) diluted with a substantially inert, normally liquid organic diluent such as mineral oil or xylene to form an additive concentrate which is then admixed with lubricating composition in sufficient amounts to improve the lubricating compositions described herein. These concentrates generally contain about 20 to 90% of the basic metal salt compositions of this invention and can optionally contain any of the above-described conventional additives. The remainder of the concentrate is the substantially inert normally liquid diluent.

Lubricating compositions made according to this invention are exemplified by the following:

EXAMPLE A

A lubricating composition suitable for use as a crankcase lubricant is prepared using a 10W-40 mineral lubricating oil base and, as additives: 5.41% of a polyisodecyl acrylate viscosity index improver; 4.2% of an ashless dispersant based on the reaction product of a polyisobutenyl succinc anhydride, pentaerythritol, and polyethylene polyamine; 1.57% of an overbased calcium sulfonate detergent; 0.82% of the basic zinc salt prepared in Example 2; 0.27% of a sulfurized isobutylene composition; and 40ppm of a conventional antifoam agent.

EXAMPLE B

A lubricating composition suitable for use as an automatic transmission fluid is prepared using an ATF base and, as additives, 0.13% of the reaction product of a dialkylphosphite and an alkyl alpha-olefin epoxide as described in U.S. Pat. No. 3,932,290; 1.75% of the reaction product of a polyisobutenyl succinic anhydride and polyethylene polyamine; 0.67% of the reaction product of boric acid with the reaction product of polyisobutenyl succinic anhydride and polyethylene polyamine; 0.52% of the basic zinc salt prepared in Example 2; 0.10% of a tallow-substituted diethanol amine; 1.20% of a mixed ester-amide of maleic anhydride-sytrene copolymer (12% solution in toluene); 3.00% hydrocarbon resin seal swelling agent; 0.20% substituted diphenyl amine; 0.04% of the reaction product of glycidol (2 moles) with $C_{12}$ primary amine mixture (1 mole); and 0.02% of a silicone antifoam agent.

EXAMPLE C

A lubricating composition suitable for use as an industrial hydraulic fluid is prepared using 200 neutral lubricating base oil, and as additives, by weight: 0.034% of nonylphenoxy poly(ethyleneoxy)ethanol surfactant; 0.023% polypropenyl-substituted succinic acid; and 0.517% of the basic zinc salt prepared in Example 2.

What is claimed is:

1. A reaction mixture suitable for preparation of basic metal salt compositions of one or more phosphorus-containing acids which comprises:

(A) at least one Group II metal salt of one or more phosphorus-containing acids of the formula

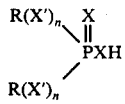

(I)

wherein each X and X′ are independently oxygen or divalent sulfur with the proviso that each $n$ may be zero or one, each R is independently the same or a different hydrocarbon-based radical and the Group II metal has an atomic weight between about 24 and about 115; and (B) at least one basically reacting alkali metal compound; wherein the equivalent ratio of the acid of (A) : (B) in the reaction mixture is sufficient to form a basic or a more basic metal salt of (A).

2. A reaction mixture according to claim 1, wherein at least one X is divalent sulfur; at least one X′ is oxygen and $n$ is one.

3. A reaction mixture according to claim 2, which further comprises (D) a substantially inert liquid solvent/diluent medium.

4. A reaction mixture according to claim 3, wherein the equivalent ratio of the acid of (A) : (B) is in a range of from about 1:0.05 up to about 1:6.

5. A process for preparing basic metal salt compositions of phosphoric acids which comprises reacting:

(A) at least one Group II metal salt of one or more phosphorus-containing acids of the formula

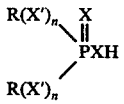

wherein each X and X′ are independently oxygen or divalent sulfur with the proviso that each $n$ may be zero or one, each R is independently the same or a different hydrocarbon-based radical, and the Group II metal has an atomic weight between about 24 and about 115; and (B) at least one basically reacting alkali metal compound;

wherein the equivalent ratio of the acid of (A) : (B) in the reaction is sufficient to form a basic or a more basic metal salt of (A).

6. A process according to claim 5, wherein at least one X is divalent sulfur.

7. A process according to claim 6, wherein X′ is oxygen and $n$ is one.

8. A process according to claim 7, wherein (B) comprises one or more inorganic compounds.

9. A process according to claim 8, wherein the reaction is conducted in the presence of a substantially inert liquid solvent/diluent medium (D).

10. A process according to claim 9, wherein the liquid solvent/diluent medium (D) comprises polar solvent/diluent.

11. A process according to claim 9, wherein each R is hydrocarbyl of 1 to about 30 carbon atoms.

12. A process according to claim 11, wherein the equivalent ratio of the acid of (A) : (B) is in a range of from about 1:0.05 up to about 1:6.

13. A process according to claim 11, wherein (B) comprises one or more alkali metal hydroxides or oxides.

14. A process according to claim 13, wherein (A) comprises one or more zinc salts.

15. A process according to claim 13, wherein (A) is selected from zinc, magnesium, calcium, and cadmium salts and mixtures thereof.

16. A process according to claim 15, wherein each R is alkyl of from 1 to about 20 carbon atoms.

17. A process according to claim 16, wherein one R contains at least 5 carbon atoms and together both R's contain a total of at least 8 carbon atoms.

18. A composition prepared according to the process of claim 5.

19. A composition prepared according to the process of claim 8.

20. A composition prepared according to the process of claim 9.

21. A composition prepared according to the process of claim 10.

22. A composition prepared according to the process of claim 12.

23. A composition prepared according to the process of claim 13.

24. A composition prepared according to the process of claim 14.

25. A composition prepared according to the process of claim 16.

26. A composition prepared according to the process of claim 17.

27. An additive concentrate comprising about 20–90% of at least one composition of claim 18 and a substantially inert, normally liquid, organic diluent.

28. An additive concentrate comprising about 20–90% of at least one composition of claim 19 and a substantially inert, normally liquid, organic diluent.

29. An additive concentrate comprising about 20–90% of at least one composition of claim 20 and a substantially inert, normally liquid, organic diluent.

30. An additive concentrate comprising about 20–90% of at least one composition of claim 21 and a substantially inert, normally liquid, organic diluent.

31. An additive concentrate comprising about 20–90% of at least one composition of claim 22 and a substantially inert, normally liquid, organic diluent.

32. An additive concentrate comprising about 20–90% of at least one composition of claim 23 and a substantially inert, normally liquid, organic diluent.

33. An additive concentrate comprising about 20–90% of at least one composition of claim 24 and a substantially inert, normally liquid, organic diluent.

34. An additive concentrate comprising about 20–90% of at least one composition of claim 25 and a substantially inert, normally liquid, organic diluent.

35. An additive concentrate comprising about 20–90% of at least one composition of claim 26 and a substantially inert, normally liquid, organic diluent.

36. A lubricant composition comprising a major amount of an oil of lubricating viscosity and a minor amount of at least one composition of claim 18.

37. A lubricant composition comprising a major amount of an oil of lubricating viscosity and a minor amount of at least one composition of claim 19.

38. A lubricant composition comprising a major amount of an oil of lubricating viscosity and a minor amount of at least one composition of claim 20.

39. A lubricant composition comprising a major amount of an oil of lubricating viscosity and a minor amount of at least one composition of claim 21.

40. A lubricant composition comprising a major amount of an oil of lubricating viscosity and a minor amount of at least one composition of claim 22.

41. A lubricant composition comprising a major amount of an oil of lubricating viscosity and a minor amount of at least one composition of claim 23.

42. A lubricant composition comprising a major amount of an oil of lubricating viscosity and a minor amount of at least one composition of claim 24.

43. A lubricant composition comprising a major amount of an oil of lubricating viscosity and a minor amount of at least one composition of claim 25.

44. A lubricant composition comprising a major amount of an oil of lubricating viscosity and a minor amount of at least one composition of claim 26.

* * * * *